US010490317B2

(12) United States Patent
Kim et al.

(10) Patent No.: US 10,490,317 B2
(45) Date of Patent: Nov. 26, 2019

(54) CONDUCTIVE LAMINATE AND TRANSPARENT ELECTRODE INCLUDING SAME

(71) Applicant: LG CHEM, LTD., Seoul (KR)

(72) Inventors: Yong Chan Kim, Daejeon (KR); Sujin Kim, Daejeon (KR); Ki-hwan Kim, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 15/559,247

(22) PCT Filed: May 13, 2016

(86) PCT No.: PCT/KR2016/005093
§ 371 (c)(1),
(2) Date: Sep. 18, 2017

(87) PCT Pub. No.: WO2016/186394
PCT Pub. Date: Nov. 24, 2016

(65) Prior Publication Data

US 2018/0096748 A1 Apr. 5, 2018

(30) Foreign Application Priority Data

May 15, 2015 (KR) ..... 10-2015-0068329

(51) Int. Cl.

| | |
|---|---|
| ***H01B 1/22*** | (2006.01) |
| ***H01B 1/02*** | (2006.01) |
| ***H01B 1/08*** | (2006.01) |
| ***H01B 13/00*** | (2006.01) |

(52) U.S. Cl.
CPC ..... *H01B 1/22* (2013.01); *H01B 1/02* (2013.01); *H01B 1/023* (2013.01); *H01B 1/08* (2013.01); *H01B 13/0036* (2013.01)

(58) Field of Classification Search
CPC ..... H01B 5/14; B32B 7/02
USPC ..... 136/252
See application file for complete search history.

(56) References Cited

U.S. PATENT DOCUMENTS

| | | | |
|---|---|---|---|
| 9,750,131 | B2 | 8/2017 | Seong et al. |
| 2003/0227250 | A1 | 12/2003 | Nee |
| 2011/0174361 | A1 | 7/2011 | Bang et al. |

FOREIGN PATENT DOCUMENTS

| | | | | |
|---|---|---|---|---|
| CN | 1665678 | A | 9/2005 | |
| CN | 101622721 | A | 1/2010 | |
| JP | 2000-351170 | * | 6/1999 | ..... B32B 7/02 |
| JP | 2012-252814 | * | 6/2011 | ..... H01B 5/14 |
| JP | 2012-252814 | A | 12/2012 | |
| KR | 10-2010-0036957 | A | 4/2010 | |
| KR | 10-2014-0011854 | A | 1/2014 | |
| KR | 10-2014-0126842 | A | 11/2014 | |
| KR | 10-2015-0016119 | A | 2/2015 | |
| KR | 10-2015-0039373 | A | 4/2015 | |
| WO | 2008105597 | A1 | 9/2008 | |

* cited by examiner

*Primary Examiner* — Khanh T Nguyen
(74) *Attorney, Agent, or Firm* — Dentons US LLP

(57) ABSTRACT

The present specification relates to a conductive laminate and a transparent electrode including the same.

13 Claims, 2 Drawing Sheets

[Figure 1]
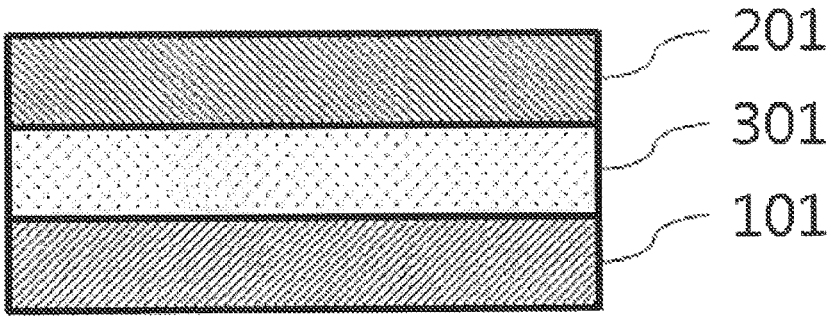
[Figure 2]
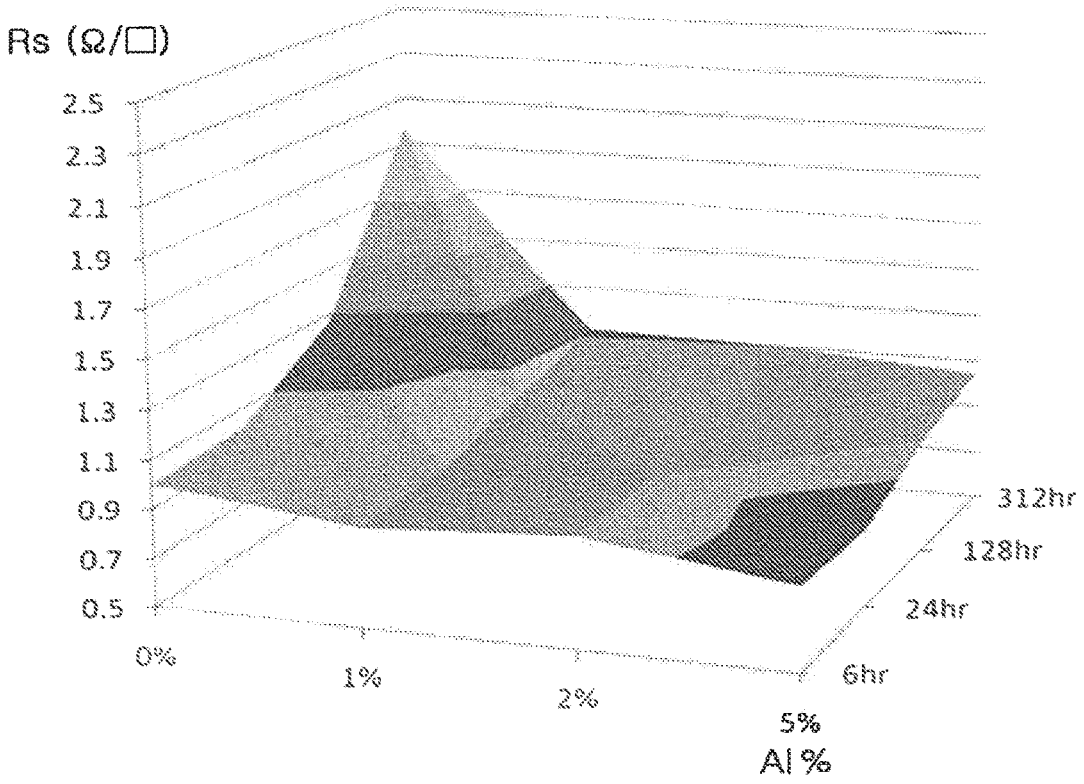

[Figure 3]
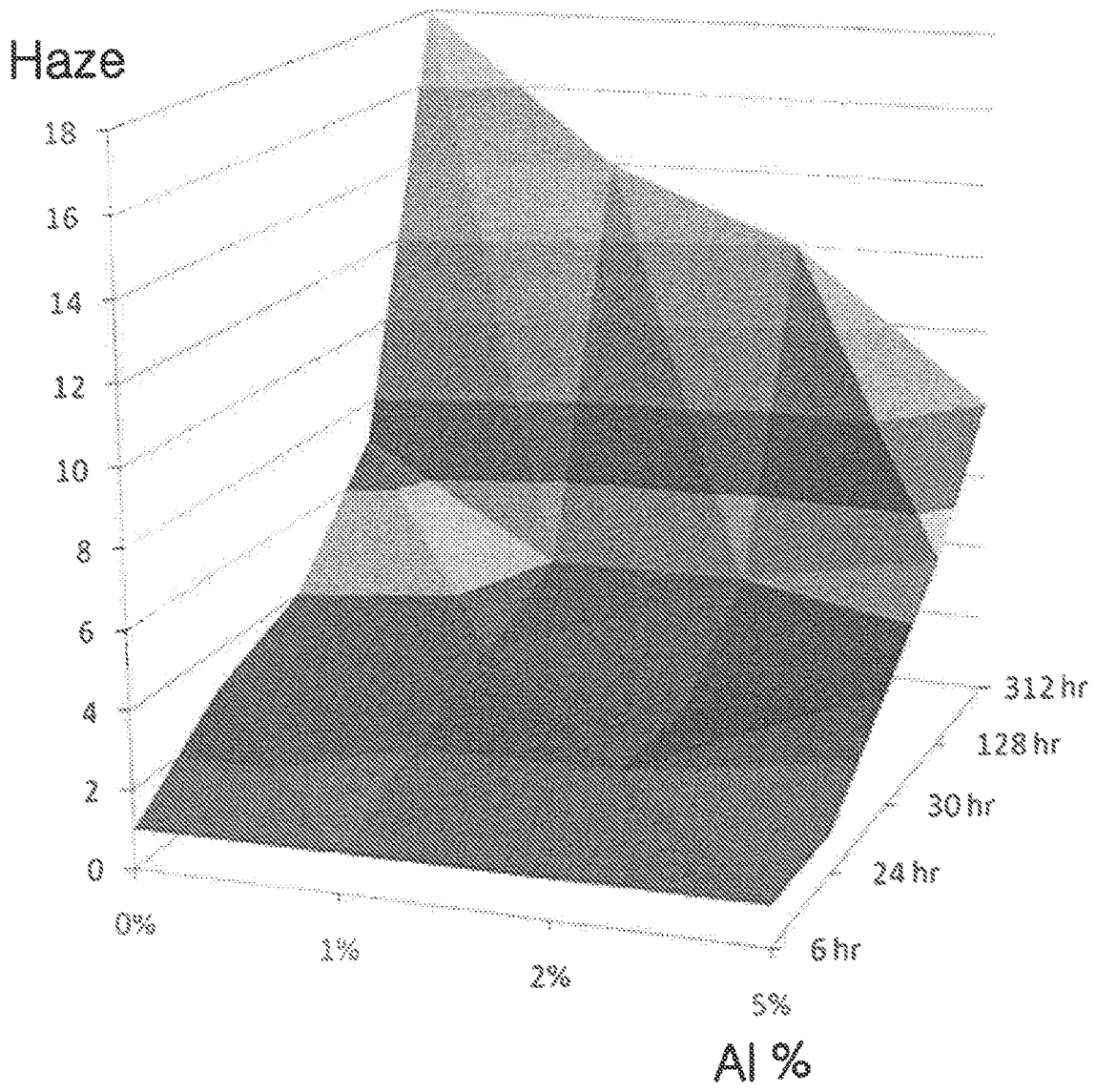

CONDUCTIVE LAMINATE AND TRANSPARENT ELECTRODE INCLUDING SAME

TECHNICAL FIELD

This application is a National Stage Entry of International Application No. PCT/KR2016/005093 filed on May 13, 2016, and claims the benefit of Korean Application No. 10-2015-0068329 filed on May 15, 2015, all of which are hereby incorporated by reference in their entirety for all purposes as if fully set forth herein. This application claims priority to and the benefit of Korean Patent Application No. 10 2015 0068329 filed in the Korean Intellectual Property Office on May 15, 2015, the entire contents of which are incorporated herein by reference.

The present specification relates to a conductive laminate and a transparent electrode including the same.

BACKGROUND ART

With sudden emergence of a new renewable energy industry together with a high-tech information technology industry, there is a growing interest in a transparent electrode with both electrical conductivity and light transmission. A transparent electrode in an organic electronic device as a thin transparent substrate needs to transmit light and simultaneously have excellent electrical conductivity.

As a material of the transparent electrode, transparent conducting oxide (TCO) fabricated in a thin film shape is representative. The transparent conductive oxide which is collectively referred to as an oxide-based degenerated semiconductor electrode having both a high optical transmittance (85% or higher) and low specific resistance ($1\times10^{-3}$ Ωm) in a visible-ray region is used as core electrode materials for functional thin films such as an antistatic film and an electromagnetic wave shielding film, a flat panel display, a solar cell, a touch panel, a transparent transistor, a flexible photoelectric device, a transparent photoelectric device, and the like according to a size of the surface resistance.

However, the transparent electrode manufactured using the transparent conductive oxide as a material has a problem in that efficiency of the device is lowered due to low electric conductivity.

DETAILED DESCRIPTION OF THE INVENTION

Technical Problem

The present specification provides a conductive laminate and a transparent electrode including the same.

Technical Solution

An exemplary embodiment of the present specification provides a conductive laminate including: a first metal oxide layer; a metal layer provided on the first metal oxide layer; and a second metal oxide layer provided on the metal layer, in which the metal layer includes a silver-aluminum alloy, the Al atom content of the metal layer is more than 0.1% and 15% or less with respect to Ag atoms of the metal layer, and a light transmittance of the conductive laminate is 80% or more in light having a wavelength of 550 nm.

Another exemplary embodiment of the present specification provides a transparent electrode including the conductive laminate.

Still another exemplary embodiment of the present specification provides an electronic device including the transparent electrode.

Advantageous Effects

The conductive laminate according to the exemplary embodiment of the present specification has advantages of a high light transmittance and a low surface resistance value. Further, the conductive laminate according to the exemplary embodiment of the present specification has excellent durability. Particularly, the conductive laminate according to the exemplary embodiment of the present specification has an advantage of excellent reliability of a product because deterioration of performance may be minimized even in severe environmental conditions.

BRIEF DESCRIPTION OF DRAWINGS

FIG. 1 illustrates a laminated structure of a conductive laminate according to an exemplary embodiment of the present specification.

FIG. 2 illustrates a change in surface resistance value of the conductive laminate over time according to Experimental Example 1.

FIG. 3 illustrates a change in haze value of the conductive laminate over time according to Experimental Example 1.

101: First metal oxide layer

201: Second metal oxide layer

301: Metal layer

BEST MODE

In this specification, it will be understood that when a member is referred to as being "on" another member, it can be directly on the other member or intervening members may also be present.

When one part "comprise" one constituent element in the present specification, unless otherwise specifically described, this does not mean that another constituent element is excluded, but means that another constituent element may be further included.

Hereinafter, the present specification will be described in more detail.

The present specification relates to a conductive laminate including: a first metal oxide layer; a metal layer provided on the first metal oxide layer; and a second metal oxide layer provided on the metal layer.

The present inventors found a problem that performance of the metal layer is degraded in a conductive laminate in which a metal layer made of silver is provided between two metal oxide layers. Such a problem may occur by agglomeration between silver particles and corrosion by an external environment, by a property for reducing surface free energy of silver forming the metal layer. Furthermore, under high temperature and high humidity conditions, degradation of performance of the metal layer is further accelerated to cause degradation of performance such as a light transmittance, haze, and electric conductivity of the conductive laminate.

As a result, the present inventors invented the conductive laminate capable of solving the problem. Particularly, in the conductive laminate according to the exemplary embodiment of the present specification, the metal layer is formed by using a silver-aluminum alloy and the aluminum content of the metal layer is more than 0.1% and 15% or less.

In the present specification, conductivity means electric conductivity.

An exemplary embodiment of the present specification provides a conductive laminate including: a first metal oxide layer; a metal layer provided on the first metal oxide layer; and a second metal oxide layer provided on the metal layer, in which the metal layer includes a silver-aluminum alloy, the Al atom content of the metal layer is more than 0.1% and 15% or less with respect to Ag atoms of the metal layer, and a light transmittance of the conductive laminate is 80% or more in light having a wavelength of 550 nm.

The metal layer may serve to embody low resistance of the conductive laminate by the excellent electric conductivity and the low specific resistance.

According to the exemplary embodiment of the present specification, the Al atom content of the metal layer may be 1% or more and 10% or less with respect to Ag atoms of the metal layer. Particularly, according to the exemplary embodiment of the present specification, the Al atom content of the metal layer may be 1% or more and 7% or less, or 1% or more and 5% or less with respect to Ag atoms of the metal layer.

When the Al atom content of the metal layer is in the range, agglomeration of silver in the metal layer may be minimized and further, durability to an environment of the metal layer may be improved.

Further, when the Al atom content of the metal layer is in the range, the conductive laminate may have excellent light transmittance and conductivity. Particularly, when the Al atom content of the metal layer is in the range, it is possible to embody the conductive laminate having an excellent light transmittance of 80% or more and a low surface resistance value of 10Ω/□ or less. Further, when the Al atom content of the metal layer is in the range, the conductive laminate has an advantage of excellent durability to an environment. Particularly, the conductive laminate may minimize degradation of performance over time and have excellent durability to a high temperature and high humidity environment.

The Al atom content may be measured by a ratio of Al atoms to Ag atoms of the metal layer through an x-ray photoelectron spectroscopy (XPS) analysis. Particularly, the Al atom content (%) may be obtained by the number of Al atoms to the number of Ag atoms obtained through the XPS analysis.

FIG. 1 illustrates a laminated structure of a conductive laminate according to an exemplary embodiment of the present specification. Particularly, FIG. 1 illustrates a conductive laminate in which a first metal oxide layer 101, a metal layer 301, and a second metal oxide layer 201 are sequentially provided.

According to the exemplary embodiment of the present specification, a thickness of the metal layer may be 5 nm or more and 20 nm or less.

When the thickness of the metal layer is in the range, there is an advantage in that the conductive laminate may have excellent electric conductivity and a low resistance value. Particularly, when the thickness of the metal layer is less than 5 nm, a continuous film is hardly formed and thus there is a problem in that it is difficult to embody low resistance, and when the thickness is more than 20 nm, there may be a problem in that the light transmittance of the conductive laminate is lowered.

According to the exemplary embodiment of the present specification, the second metal oxide layer may be doped with aluminum. That is, according to the exemplary embodiment of the present specification, the second metal oxide layer may further include aluminum.

According to the exemplary embodiment of the present specification, the concentration of the doped aluminum may be 0.1 wt % or more and 10 wt % or less with respect to the second metal oxide layer.

According to the exemplary embodiment of the present specification, the second metal oxide layer further includes the aluminum to improve electron mobility in an electronic device and has a high refractive characteristic to improve a light transmittance of the conductive laminate through an optical design. Further, since the second metal oxide layer has electric conductivity, electric conductivity of the metal layer is not inhibited and the conductive laminate may serve as a transparent electrode in various electronic devices.

According to the exemplary embodiment of the present specification, the first metal oxide layer and the second metal oxide layer may include oxides including one or more selected from a group consisting of Sb, Ba, Ga, Ge, Hf, In, La, Ma, Se, Si, Ta, Se, Ti, V, Y, Zn, and Zr, respectively.

According to the exemplary embodiment of the present specification, the thickness of the first metal oxide layer and the thickness of the second metal oxide layer may be 20 nm or more and 80 nm or less, respectively.

According to the exemplary embodiment of the present specification, the thickness of the first metal oxide layer may be 20 nm or more and 60 nm or less. Particularly, according to the exemplary embodiment of the present specification, the thickness of the first metal oxide layer may be 30 nm or more and 40 nm or less.

When the thickness of the first metal oxide layer is in the range, there is an advantage in that a light transmittance of the conductive laminate having a multilayered thin film form is excellent. Particularly, when the thickness of the first metal oxide layer is beyond the range, there is a problem in that the light transmittance of the conductive laminate is lowered. Further, when the thickness is beyond the range, a defect ratio of the deposited metal layer may be increased.

According to the exemplary embodiment of the present specification, the thickness of the second metal oxide layer may be 20 nm or more and 80 nm or less. Particularly, according to the exemplary embodiment of the present specification, the thickness of the second metal oxide layer may be 40 nm or more and 50 nm or less.

When the thickness of the second metal oxide layer is in the range, there is an advantage in that the conductive laminate may have excellent electric conductivity and a low resistance value. Particularly, the thickness range of the second metal oxide layer is obtained through an optical design, and when the thickness is beyond the range, there is a problem in that the light transmittance of the conductive laminate is lowered.

The first metal oxide layer is a high refractive material and may serve to enhance a light transmittance of the multilayered conductive laminate using the metal layer and facilitate deposition of the metal layer.

According to the exemplary embodiment of the present specification, refractive indexes of the first metal oxide layer and the second metal oxide layer may be 1.2 or more and 3 or less in the light having a wavelength of 550 nm, respectively.

In the present specification, the refractive index means a light refractive index.

The first metal oxide layer is a high refractive material and may serve to enhance a light transmittance of the multilayered conductive laminate using the metal layer and facilitate deposition of the metal layer.

According to the exemplary embodiment of the present specification, the refractive index of the first metal oxide layer may be 1.2 or more and 2.8 or less in the light having a wavelength of 550 nm. Particularly, the refractive index of the first metal oxide layer may be 1.9 or more and 2.75 or less.

According to the exemplary embodiment of the present specification, the refractive index of the second metal oxide layer may be 1.5 or more and 2.5 or less in the light having a wavelength of 550 nm.

The refractive index of each layer is obtained through an optical design to embody the light transmittance of the conductive laminate of 80% or more. Therefore, when the refractive index is beyond the range, there is a problem in that the light transmittance of the conductive laminate is decreased to 80% or less.

Further, the refractive index of each layer is adjusted by the thickness and may also be adjusted by controlling a deposition process. Particularly, crystallinity may be adjusted by adjusting a deposition condition of each layer and as a result, in spite of the same thickness and material, a refractive index may vary.

According to the exemplary embodiment of the present specification, the conductive laminate further includes a transparent supporter and the first metal oxide layer may be provided on the transparent supporter.

The transparent supporter may be a glass substrate or a transparent plastic substrate having excellent transparency, surface smoothness, ease of handling, and waterproofness, but is not limited thereto and is not limited as long as any substrate is commonly used in an electronic device. Particularly, the substrate may be made of glass; a urethane resin; a polyimide resin; a polyester resin; a (meth)acrylate-based polymer resin; a polyolefin-based resin such as polyethylene or polypropylene, and the like.

According to the exemplary embodiment of the present specification, $R/R_0$ of the conductive laminate may be 1.2 or less.

The $R_0$ is an initial surface resistance value of the conductive laminate, and R is a surface resistance value of the conductive laminate after 312 hours elapse at an atmosphere of 85° C. and 85 RH %.

According to the exemplary embodiment of the present specification, $H/H_0$ of the conductive laminate may be 14 or less.

The $H_0$ is an initial haze value of the conductive laminate, and H is a haze value of the conductive laminate after 312 hours elapse at an atmosphere of 85° C. and 85 RH %.

In the conductive laminate according to the exemplary embodiment of the present specification, in spite of a condition in which 128 hours elapse at a temperature of 85° C. and 85 RH %, the surface resistance value and/or the haze value may not be largely changed. According to the exemplary embodiment of the present specification, the reason is that agglomeration and oxidation of silver in the metal layer may be minimized by aluminum in the metal layer.

Therefore, the conductive laminate according to the exemplary embodiment of the present specification has an advantage of excellent reliability of a product because degradation of performance may be minimized even in severe environmental conditions.

According to the exemplary embodiment of the present specification, a surface resistance value of the conductive laminate may be 20Ω/□ or less. Specifically, according to the exemplary embodiment of the present specification, the surface resistance value of the transparent electrode may be 10Ω/□ or less.

According to the exemplary embodiment of the present specification, a surface resistance value of the transparent electrode may have a value of 0.1Ω/□ or more and 20Ω/□ or less. The surface resistance value of the transparent electrode may be determined by the metal layer and the low surface resistance value can be embodied by the thickness range of the metal layer and the thickness range of the second metal oxide layer.

When the transparent electrode is applied to the electronic device, there is an advantage of enhancing efficiency of the electronic device by the low surface resistance value. Furthermore, in spite of the low surface resistance value, there is an advantage of a high light transmittance.

According to the exemplary embodiment of the present specification, the entire thickness of the conductive laminate may be 50 nm or more and 300 nm or less.

The thickness of the conductive laminate may be determined by an optical design. For the optical design, a refractive index for each layer of the conductive laminate is required and the thickness of each layer may be determined by the value. That is, in order to embody the light transmittance of the conductive laminate to 80% or more, the entire thickness of the conductive laminate may be 50 nm or more and 300 nm or less and more particularly 70 nm or more and 200 nm or less.

According to the exemplary embodiment of the present specification, the light transmittance of the conductive laminate may be 80% or more in light having a wavelength of 550 nm. Particularly, according to the exemplary embodiment of the present specification, the light transmittance of the conductive laminate may be 85% or more or 90% or more in the light having a wavelength of 550 nm.

According to the exemplary embodiment of the present specification, the haze value of the conductive laminate may be 1 or less. Specifically, according to the exemplary embodiment of the present specification, the haze value of the conductive laminate may be 0.5 or less.

In the present specification, the "haze value" is a value measured by using a color research laboratory HM-150 hazemeter by Murakami Corporation.

Since the conductive laminate according to the exemplary embodiment of the present specification has an excellent light transmittance and a low haze value, the conductive laminate may be used for the transparent electrode of the electronic device. Furthermore, the conductive laminate has a low light loss rate due to a high light transmittance to enhance efficiency of the electronic device.

An exemplary embodiment of the present specification provides a transparent electrode including the conductive laminate.

An exemplary embodiment of the present specification provides an electronic device including the transparent electrode. The electronic device including the transparent electrode including the conductive laminate may embody a high reaction speed due to the conductive laminate having the high light transmittance and the low surface resistance.

According to the exemplary embodiment of the present specification, the electronic device may be a touch panel, light emitting glass, a light emitting device, a solar cell or a transistor.

The touch panel, the light emitting glass, the light emitting device, the solar cell, and the transistor may be commonly known in the art, and the electrode may be used as the transparent electrode of the present specification.

Hereinafter, the present specification will be described in detail with reference to Examples for a specific description. However, the Examples according to the present specification may be modified in various different forms, and it is not interpreted that the scope of the present specification is limited to the Examples described in detail below. The Examples of the present specification will be provided for more completely explaining the present specification to those skilled in the art.

Example 1

A first metal oxide layer was formed by depositing Nb oxide on a glass substrate with a thickness of 30 nm by using an RF sputter method. A metal layer made of an Ag—Al alloy of which the Al atom content was 1% with respect to Ag atoms was deposited on the first metal oxide layer with a thickness of 10 nm by using a DC sputter method. A Ga-doped zinc oxide layer (GZO) as a second metal oxide layer was deposited on the metal layer with a thickness of 50 nm to manufacture a conductive laminate.

As the result of measuring a visible light transmittance by using a UV-vis spectrometer, the conductive laminate manufactured according to Example 1 had a transmittance of 90.0% at a wavelength of 550 nm. Further, a surface resistance of the conductive laminate manufactured according to Example 1 had a value of 6.97Ω/□ or less as the result of being measured by a surface resistance meter and a measured result of the haze value was 0.1.

Example 2

A first metal oxide layer was formed by depositing Nb oxide on a glass substrate with a thickness of 30 nm by using an RF sputter method. A metal layer made of an Ag—Al alloy of which the Al atom content was 2% with respect to Ag atoms was deposited on the first metal oxide layer with a thickness of 10 nm by using a DC sputter method. A Ga-doped zinc oxide layer (GZO) as a second metal oxide layer was deposited on the metal layer with a thickness of 50 nm to manufacture a conductive laminate.

As the result of measuring a visible light transmittance by using a UV-vis spectrometer, the conductive laminate manufactured according to the Example 2 had a transmittance of 89.2% at a wavelength of 550 nm. Further, a surface resistance of the conductive laminate manufactured according to Example 2 had a value of 7.38Ω/□ or less as the result of being measured by a surface resistance meter and a measured result of the haze value was 0.1.

In the metal layers of the conductive laminates manufactured according to Examples 2 and 3, the result of measuring a composition of Al and Ag by using XPS was as follows.

Example 3

A first metal oxide layer was formed by depositing Nb oxide on a glass substrate with a thickness of 30 nm by using an RF sputter method. A metal layer made of an Ag—Al alloy of which the Al atom content was 5% with respect to Ag atoms was deposited on the first metal oxide layer with a thickness of 10 nm by using a DC sputter method. A Ga-doped zinc oxide layer (GZO) as a second metal oxide layer was deposited on the metal layer with a thickness of 50 nm to manufacture a conductive laminate.

As the result of measuring a visible light transmittance by using a UV-vis spectrometer, the conductive laminate manufactured according to the Example 3 had a transmittance of 86.4% at a wavelength of 550 nm. Further, a surface resistance of the conductive laminate manufactured according to Example 3 had a value of 13.55Ω/□ or less as the result of being measured by a surface resistance meter and a measured result of the haze value was 0.1.

The result of measuring atom contents of Al and Ag of the metal layer in Examples 2 and 3 by using XPS is as illustrated in Table 1 below.

TABLE 1

| | Al | Ag | Al/Ag |
|---|---|---|---|
| Example 2 | 4.58 | 56.5 | 0.08 |
| Example 3 | 5.61 | 38.85 | 0.14 |

Comparative Example 1

A first metal oxide layer was formed by depositing Nb oxide on a glass substrate with a thickness of 30 nm by using an RF sputter method. A metal layer made of Ag was deposited on the first metal oxide layer with a thickness of 10 nm by using a DC sputter method and a Ga-doped zinc oxide layer (GZO) as a second metal oxide layer was deposited on the metal layer with a thickness of 50 nm to manufacture a conductive laminate.

As the result of measuring a visible light transmittance by using a UV-vis spectrometer, the conductive laminate manufactured according to Comparative Example 1 had a transmittance of 90.4% at a wavelength of 550 nm. Further, a surface resistance of the conductive laminate manufactured according to Comparative Example 1 had a value of 6.89Ω/□ or less as the result of being measured by a surface resistance meter and a measured result of the haze value was 0.1.

Experimental Example 1—Evaluation of Anti-Environment

In order to measure durability of the conductive laminate manufactured according to the Example and the conductive laminate manufactured according to the Comparative Example, a change in surface resistance value over time at an atmosphere of 85° C. and 85 RH % was measured.

FIG. 2 illustrates a change in surface resistance Rs value of the conductive laminate over time according to Experimental Example 1.

Experimental Example 2—Evaluation of Anti-Environment

In order to measure durability of the conductive laminate manufactured according to the Example and the conductive laminate manufactured according to the Comparative Example, a change in haze value over time at an atmosphere of 85° C. and 85 RH % was measured.

FIG. 3 illustrates a change in haze value of the conductive laminate over time according to Experimental Example 1.

The invention claimed is:

1. A conductive laminate comprising:

a first metal oxide layer;

a metal layer provided on the first metal oxide layer; and a second metal oxide layer provided on the metal layer, wherein the metal layer includes a silver-aluminum alloy, the Al atom content of the metal layer is more than 1% and 10% or less with respect to Ag atoms of the metal layer, and a light transmittance of the conductive laminate is 80% or more in light having a wavelength of 550 nm, wherein $R/R_0$ of the conductive laminate is 1.2 or less, the $R_0$ is an initial surface resistance value of the conductive laminate, and R is a surface resistance value of the conductive laminate after 312 hours elapse at an atmosphere of 85° C. and 85 RH %, wherein the first metal oxide is Nb oxide, and wherein the second metal oxide is Ga-doped zinc oxide.

2. The conductive laminate of claim 1, wherein the thickness of the metal layer is 5 nm or more and 20 nm or less.

3. The conductive laminate of claim 1, wherein the second metal oxide layer is doped with aluminum.

4. The conductive laminate of claim 3, wherein the concentration of the doped aluminum is 0.1 wt % or more and 10 wt % or less with respect to the second metal oxide layer.

5. The conductive laminate of claim 1, wherein the thickness of the first metal oxide layer and the thickness of the second metal oxide layer are 20 nm or more and 80 nm or less, respectively.

6. The conductive laminate of claim 1, wherein refractive indexes of the first metal oxide layer and the second metal oxide layer are 1.2 or more and 3 or less in the light having a wavelength of 550 nm, respectively.

7. The conductive laminate of claim 1, further comprising:

a transparent supporter, wherein the first metal oxide layer is provided on the transparent supporter.

8. The conductive laminate of claim 1, wherein $H/H_0$ of the conductive laminate is 14 or less, the $H_0$ is an initial haze value of the conductive laminate, and H is a haze value of the conductive laminate after 312 hours elapse at an atmosphere of 85° C. and 85 RH %.

9. The conductive laminate of claim 1, wherein a surface resistance value of the conductive laminate is 20 Ω/sq or less.

10. The conductive laminate of claim 1, wherein a haze value of the conductive laminate is 1 or less.

11. The conductive laminate of claim 1, wherein the entire thickness of the conductive laminate is 50 nm or more and 300 nm or less.

12. A transparent electrode comprising the conductive laminate of claim 1.

13. An electronic device comprising the transparent electrode of claim 12.

* * * * *